US007448893B2

(12) United States Patent
Suzuki

(10) Patent No.: US 7,448,893 B2
(45) Date of Patent: Nov. 11, 2008

(54) CONNECTOR

(75) Inventor: Masayuki Suzuki, Tokyo (JP)

(73) Assignee: DDK Ltd., Tokyo (JP)

( * ) Notice: Subject to any disclaimer, the term of this patent is extended or adjusted under 35 U.S.C. 154(b) by 7 days.

(21) Appl. No.: 11/752,204

(22) Filed: May 22, 2007

(65) Prior Publication Data

US 2007/0298628 A1 Dec. 27, 2007

(30) Foreign Application Priority Data

Jun. 21, 2006 (JP) ..... 2006-171475

(51) Int. Cl.
*H01R 13/15* (2006.01)

(52) U.S. Cl. ..... 439/260

(58) Field of Classification Search ..... 439/260, 439/261, 495

See application file for complete search history.

(56) References Cited

U.S. PATENT DOCUMENTS

| | | | | |
|---|---|---|---|---|
| 6,250,966 | B1 * | 6/2001 | Hashimoto et al. | 439/631 |
| 6,726,497 | B2 * | 4/2004 | Nogawa et al. | 439/260 |
| 7,168,976 | B1 * | 1/2007 | Huang | 439/495 |
| 7,214,081 | B1 * | 5/2007 | Ju | 439/260 |
| 7,291,040 | B2 * | 11/2007 | Kato | 439/495 |
| 2004/0023551 | A1 * | 2/2004 | Suzuki et al. | 439/495 |
| 2005/0260885 | A1 * | 11/2005 | Lu | 439/495 |

FOREIGN PATENT DOCUMENTS

| | | |
|---|---|---|
| JP | 05-326084 | 12/1993 |
| JP | 60-060983 | 9/1994 |
| JP | 2002-270290 | 9/2002 |
| JP | 2004-206987 | 7/2004 |

* cited by examiner

*Primary Examiner*—Phuong K Dinh
(74) *Attorney, Agent, or Firm*—Hogan & Hartson LLP

(57) ABSTRACT

A connector includes a required number of contacts of three kinds and a housing having inserting holes for these contacts. One set of three contacts or contacts A, B and C are inserted into the same inserting hole of the housing. The contact A is inserted into the inserting hole from the side of a fitting opening of the housing, while the contact B and the contact C are inserted in parallel with each other into the inserting hole from the opposite side of the fitting opening such that the contact A and the contact C are aligned with each other and the contact A and the contact B are arranged to be staggered relative to each other, thereby bringing a flexible printed circuit board into contact with the contacts A and contacts B upon insertion of the circuit board. With this construction, narrow pitches less than 0.25 mm can be obtained, and high density can also be achieved.

3 Claims, 6 Drawing Sheets

CONNECTOR

BACKGROUND OF THE INVENTION

The present invention relates to a connector for use in electric and electronic appliances such as mobile devices, and more particularly to a connector which achieves extremely narrow pitches for a connecting object such as a flexible printed circuit board, flexible flat cable and the like.

In general, connectors for use in electric and electronic appliances such as mobile devices and the like are much thinner and having contacts arranged in extremely narrow pitches (so-called lighter and more compact connector). Such a connector of one type mainly comprises a housing and contacts, and a flexible printed circuit board is inserted into the housing to force the circuit board into contact with contact portions of the contacts (so-called "non-zero-insertion force (NZIF)" type). Moreover, another type connector mainly comprises a housing, contacts and a member so that a flexible printed circuit board is embraced between the housing and the member (so-called "zero-insertion force (ZIF)" type). Various methods may be envisioned for holding a flexible printed circuit board by means of the housing and the member. In many cases, there have been constructions in which after a flexible printed circuit board has been inserted into a housing, a member is inserted into the housing to press the circuit board against the contacts. In recent years, however, a type having a member to be rotated on the side of a fitting opening (front lock type) and a type having a member to be rotated on the opposite side of a fitting opening (rear lock type) have been increasingly being used. On the other hand, depending upon customer's demands or for achieving the narrow pitches, it may be sometimes unavoidable that connection portions of contacts should be located on the side of a fitting opening of a housing into which a flexible printed circuit board is inserted.

A housing may be usually formed with a required number of inserting holes for inserting contacts, and a fitting opening into which a flexible printed circuit board is inserted.

In general, contacts each comprise a contact portion adapted to contact a flexible printed circuit board, a connection portion to be connected to a substrate or the like, and a fixed portion to be fixed to the housing. These contacts may be fixed to the housing as by press-fitting.

In order to connect between a substrate and a connecting object such as a flexible printed circuit board and the like, hitherto, the connectors as described above have generally been used.

As examples of relevant connectors, incorporated herein are Japanese Utility Model Application Opened No. H6-60, 983 (1994) of a zero-insertion fore (ZIF) type connector (Patent Literature 1), Japanese Patent Application Opened No. H5-326,084 (1993) of a non-zero-insertion force (NZIF) type connector (Patent Literature 2), Japanese Patent Application Opened No. 2002-270,290 of a so-called rear lock type connector (Patent Literature 3), and Japanese Patent Application Opened No. 2004-206,987 of a connector using contacts of two kinds (Patent Literature 4).

Patent Literature 1

For example, Japanese Utility Model Application Opened No. H6-60,983/1994 discloses connectors of the zero-insertion force (ZIF) type. According to the abstract of the Japanese Utility Model, this invention relates to a connector having a slider for a printed circuit board for use in a narrow space in an electronic or communication appliance. The slider of a connector is formed at ends of both sides with U-shaped arms with their proximal ends fixed to the slider as guiding means when being inserted into a housing. The U-shaped arms are each provided on its opening side with a projection and formed with a notch such that the opening end is visible from the inserting side. The housing is provided at both the ends with projections having an oblique surface adapted to engage the projection of the slider. When the slider together with connection terminals of a flexible printed circuit board is inserted into the housing, the projections of the slider ride over the projections having the oblique surface of the housing so that the opening ends of the U-shaped arms of the slider are temporarily spread outwardly and then returned to their normal positions when the insertion has been completed.

Patent Literature 2

According to the abstract of the Japanese Patent Application Opened No. H5-326,084, this invention has an object to provide a connector for a circuit board, which is capable of securely connecting a circuit board having along an edge signal inputting and outputting terminals particularly miniaturized and arranged with narrower pitches without causing any positional deviation, thereby improving productivity. Disclosed in this Patent Literature 2 is a connector for a circuit board, including jack terminals provided at locations corresponding to a plurality of signal inputting and outputting terminals formed in a row along an edge of the circuit board and to be individually connected to the signal inputting and outputting terminals, and an insulator for arranging these jack terminals, and after the circuit board has been inserted into an opening of the insulator on the jack terminal contact side from the signal inputting and outputting terminal forming side, said circuit board being pushed and moved to the jack terminal contact side to cause the contacts to be connected to the corresponding signal inputting and outputting terminals, wherein in the region of the insulator into which the circuit board is inserted, there are provided means for positioning the circuit board inserted to a predetermined position at least on both the sides in the width direction of the signal inputting and outputting terminal forming region.

Patent Literature 3

According to the abstract of the Japanese Patent Application Opened No. 2002-270,290, this invention has an object to provide a reduced overall height connector having an actuator which is actuated by a slight operating force and capable of enlarging moving distances of contacts to securely performing connection. Disclosed is a connector comprising an actuator having cam portions and an actuating portion, between both the portions being formed with relief grooves into which tips of spring potions of the contacts are inserted and removed, so that when the actuator is rotated about its fulcrum through 90° in a clockwise direction, the cam portions cause the spring portions and connecting spring portions of the respective contacts to be elastically deformed to embrace a flexible printed circuit board between projections of the contact portions, with the result that patterns of the flexible printed circuit board are connected to a printed substrate through terminals of the contacts, and an insulator having a ceiling portion covering the contact portions of the respective contacts and formed in the lower portion of the front side of the ceiling portion with a guide portion for inserting the flexible printed circuit board into the connector.

Patent Literature 4

According to the abstract of the Japanese Patent Application Opened No. 2004-206,987, this invention has an object to provide a connector for accommodating narrowed pitches and for tolerating a flexible printed circuit board having contact portions on both surfaces. Disclosed is a connector including a required number of contacts each having a contact portion adapted to contact a flexible printed circuit board, and a housing for holding and fixing the contacts and having a fitting opening for inserting a flexible printed circuit board, wherein when the flexible printed circuit board has contact portions on both front and rear surfaces, contacts of two kinds are used in a manner such that the contacts of one kind are inserted into the housing from the opposite side of the fitting opening so as to permit their contact portions to contact the contact portions on the front surface of the circuit board, and the contacts of the other kind are inserted into the housing from the side of the fitting opening so as to permit their contact portions to contact the contact portions on the rear surface of the circuit board.

In recent years, with the miniaturization of electric and electronic appliances, the need for connectors of this kind to be more miniaturized has become stronger. On the other hand, the requirement for narrower pitches has become stronger, and at the same time the requirement for signal density to increase (high density) has been stronger.

However, the connectors hitherto used and the connectors disclosed in the Patent Literatures 1 to 4 could not achieve narrow pitches less than 0.25 mm, and it would be impossible to achieve the high density, while maintaining narrow pitches. These problems remain to be solved.

SUMMARY OF THE INVENTION

In view of the problems of the prior art described above, it is an object of the invention to provide a connector which achieves the narrow pitches less than 0.25 mm and enables the high density.

The object of the invention can be achieved by the connector 10 with which a flexible printed circuit board 80 is detachably fitted, including a required number of contacts each having a contact portion adapted to contact said flexible printed circuit board 80, and a housing 12 having inserting holes 28 for arranging and fixing said contacts therein and having a fitting opening 24 for inserting said flexible printed circuit board therein, wherein the contacts of three kinds (contact A 14, contact B 16, and contact C 18) are inserted into the same inserting hole 28 of said housing 12 in a manner that the contact (the contact A 14) of one kind is inserted into the inserting hole from the side of the fitting opening 24 and the remaining contacts (the contact B 16 and the contact C 18) of the two kinds are inserted in parallel with each other into the inserting hole from the opposite side of the fitting opening 24, wherein said contact (the contact A 14) of the one kind and one (the contact C 18) of the remaining contacts of the two kinds are arranged in alignment with each other, and said contact (the contact A 14) of the one kind and the other contact (the contact B 16) of the two kinds are arranged to be staggered relative to each other, and wherein upon insertion of said flexible printed circuit board 80 into said fitting opening 24, said flexible printed circuit board 80 becomes into contact with said contacts (the contacts A 14) of the one kind and said other contacts (the contacts B 16) of the two kinds.

The connector 10 as claimed in claim 2 is constructed in the connector of claim 1 that said contacts A 14 each comprise at one end a connection portion 143 and at the other end a contact portion 141 adapted to contact said flexible printed circuit board 80, that said contacts B 16 each comprise a first piece 29 having at one end a contact portion 161 adapted to contact said flexible printed circuit board 80 and at the other end a connection portion 163 to be connected to a substrate, a second piece 291 having at one end an urging portion 30 facing to said contact portion 161 of said first piece to sandwich said flexible printed circuit board 80, and an elastic jointing portion 34 for connecting the first piece 29 and the other end of the second piece 291, and that said contacts C 18 each comprise a first piece 29 having at one end an urging portion 30 facing to the contact portion 141 of said contact A 14 for embracing said flexible printed circuit board 80, a second piece 291 being substantially parallel to the connection portion 163 of said contact B 16 and in contact with the lower surface of said inserting hole 28 of said housing 12, and an elastic jointing portion 34 for connecting the other end of the first piece 29 and the second piece 291, and upon insertion of said flexible printed circuit board 80 into said fitting opening 24, the flexible printed circuit board 80 comes into contact with said contacts A 14 and said contacts B 16.

The connector 10 as claimed in claim 3 is constructed in the connector of claim 1 or 2 that said contacts B 16 are each provided at the second piece 291 with a pressure receiving portion 32 extending from the other end of the second piece 291 and facing to the connection portion 163 of said contact B 16, and said contacts C 18 are each provided at the first piece 29 with a pressure receiving portion 32 extending from the other end of the first piece 29 substantially in parallel with the pressure receiving portion 32 of said contact B 16 and further provided at the second piece 291 with an extension portion 40 extending from the one end of the second piece 291 and facing to said pressure receiving portion 32 of the first piece 29, and that a member 20 is mounted on said housing 12 on the opposite side of the fitting opening 24 and is provided with anchoring holes 46 into which the pressure receiving portions 32 of said contacts B 16 and said contacts C 18 are inserted and with cam portions 48 for urging the pressure receiving portions 32 of said contacts B 16 and said contacts C 18, and said member 20 is rotated between the pressure receiving portions 32 and the connection portions 163 of said contacts B 16 and between the pressure receiving portions 32 and the extension portions 40 of said contacts C 18 to cause the urging portions 30 of said contacts B 16 and said contacts C 18 to urge said flexible printed circuit board 80, thereby bringing the contact portions 141 and 161 of said contacts A 14 and said contacts B 16 into contact with said flexible printed circuit board 80.

The connector 10 as claimed in claim 4 is constructed in the connector of claim 1, 2 or 3 that the contact portions 141 and 161 of said contacts A 14 and said contacts B 16 are inclined.

As can be seen from the above description, the connector 10 according to the invention can bring about the following significant functions and effects.

(1) In a connector 10 with which a flexible printed circuit board 80 is detachably fitted, including a required number of contacts each having a contact portion adapted to contact said flexible printed circuit board 80, and a housing 12 having inserting holes 28 for arranging and fixing said contacts therein and having a fitting opening 24 for inserting said flexible printed circuit board therein, according to the invention that the contacts of three kinds (contact A 14, contact B 16, and contact C 18) are inserted into the same inserting hole 28 of said housing 12 in a manner that the contact (the contact A 14) of one kind is inserted into the inserting hole from the side of the fitting opening 24 and the remaining contacts (the contact B 16 and the contact C 18) of the two kinds are inserted in parallel with each other into the inserting hole from the opposite side of the fitting opening 24, that said contact (the contact A 14) of the one kind and one (the contact C 18) of the remaining contacts of the two kinds are arranged in alignment with each other, and said contact (the contact A 14) of the one kind and the other contact (the contact B 16) of the two kinds are arranged to be staggered relative to each other, and that upon insertion of said flexible printed circuit board 80 into said fitting opening 24, said flexible printed circuit board 80 comes into contact with said contacts (the contacts A 14) of the one kind and said other contacts (the contacts B 16) of the two kinds. Therefore, the high density can be obtained, and the narrow pitches less than 0.25 mm can be achieved. Further, the stable connection with the flexible printed circuit board can be realized.

(2) The connector 10 as claimed in claim 2 is constructed that said contacts A 14 each comprise at one end a connection portion 143 and at the other end a contact portion 141 adapted to contact said flexible printed circuit board 80, that said contacts B 16 each comprise a first piece 29 having at one end a contact portion 161 adapted to contact said flexible printed circuit board 80 and at the other end a connection portion 163 to be connected to a substrate, a second piece 291 having at one end an urging portion 30 facing to said contact portion 161 of said first piece for embracing said flexible printed circuit board 80, and an elastic jointing portion 34 for connecting the first piece 29 and the other end of the second piece 291, and that said contacts C 18 each comprise a first piece 29 having at one end an urging portion 30 facing to the contact portion 141 of said contact A 14 for embracing said flexible printed circuit board 80, a second piece 291 being substantially parallel to the connection portion 163 of said contact B 16 and in contact with the lower surface of said inserting hole 28 of said housing 12, and an elastic jointing portion 34 for connecting the other end of the first piece 29 and the second piece 291, and upon insertion of said flexible printed circuit board 80 into said fitting opening 24, the flexible printed circuit board 80 comes into contact with said contacts A 14 and said contacts B 16. Accordingly, even with narrow pitches less than 0.25 mm, the stable connection can be obtained.

(3) The connector 10 as claimed in claim 3 is constructed that said contacts B 16 are each provided at the second piece 291 with a pressure receiving portion 32 extending from the other end of the second piece 291 and facing to the connection portion 163 of said contact B 16, and said contacts C 18 are each provided at the first piece 29 with a pressure receiving portion 32 extending from the other end of the first piece 29 substantially in parallel with the pressure receiving portion 32 of said contact B 16 and further provided at the second piece 291 with an extension portion 40 extending from the one end of the second piece 291 and facing to said pressure receiving portion 32 of the first piece 29, and that a member 20 is mounted on said housing 12 on the opposite side of the fitting opening 24 and is provided with anchoring holes 46 into which the pressure receiving portions 32 of said contacts B 16 and said contacts C 18 are inserted and with cam portions 48 for urging the pressure receiving portions 32 of said contacts B 16 and said contacts C 18, and said member 20 is rotated between the pressure receiving portions 32 and the connection portions 163 of said contacts B 16 and between the pressure receiving portions 32 and the extension portions 40 of said contacts C 18 to cause the urging portions 30 of said contacts B 16 and said contacts C 18 to urge said flexible printed circuit board 80, thereby bringing the contact portions 141 and 161 of said contacts A 14 and said contacts B 16 into contact with said flexible printed circuit board 80. Consequently, any force for inserting the flexible printed circuit board 80 is not required (a so-called "zero-insertion force"). Further, the narrow pitches less than 0.25 can be achieved and the stable connection with the flexible printed circuit board 80 can be realized.

(4) According to the connector 10 as claimed in claim 4, the contact portions 141 and 161 of said contacts A 14 and said contacts B 16 are inclined. Therefore, stable connection can be obtained.

The important aspect of the invention lies in the facts that the contacts of three kinds (contact A 14, contact B 16, and contact C 18) are inserted into the same inserting hole 28 of said housing 12 in a manner that the contact (the contact A 14) of one kind is inserted into the inserting hole from the side of the fitting opening 24, and the remaining contacts (the contact B 16 and the contact C 18) of the two kinds are inserted in parallel with each other into the inserting hole from the opposite side of the fitting opening 24, that said contact (the contact A 14) of the one kind and one (the contact C 18) of the remaining contacts of the two kinds are arranged in alignment with each other, and said contact (the contact A 14) of the one kind and the other contact (the contact B 16) of the two kinds are arranged to be staggered relative to each other, and that upon insertion of said flexible printed circuit board 80 into said fitting opening 24, said flexible printed circuit board 80 comes into contact with said contacts (the contacts A 14) of one kind and said other contacts (the contacts B 16) of the two kinds. There are three types for configurations utilizing this important aspect of the present invention. The three types are the same in the feature of bringing the flexible printed circuit board into contact with the contacts, but are different in manner for bringing the circuit board into contact with the contacts.

The connector of the first construction mainly comprises the housing 12, the contacts 14, 16 and 18, and the member 20 which is pivotally moved (rotated) to urge the flexible printed circuit board 80 against the contacts 14 and 16. The position where said member 20 is pivotally moved is located on the side of the connection portions of the contacts (rear side). This type will be explained in the following embodiment.

The connector of the second construction mainly comprises the housing and contacts, and the flexible printed circuit board 80 is inserted into the fitting opening 24 of said housing 12 to cause the circuit board 80 to contact (to be pressed against) the contacts without using the member (so-called non-zero-insertion force (NZIF) type). In other words, the flexible printed circuit board 80 is forced into the space, narrower than the thickness of the circuit board, between the contact portions of said contacts and between the contacts and the housing 12 so that the circuit board is caused to contact (to be pressed against) the contacts. (The connector of this type is not shown in the drawings.)

The connector of the third construction mainly comprises the housing 12, the contacts 14, 16 and 18, and the member 20 which is inserted into the housing to cause the circuit board 80 to be pushed against the contacts 14 and 16. After said circuit board 80 has been inserted into the housing, the member 20 is inserted into the fitting opening 24. (The connector of this type is not shown in the drawings).

Needless to say, all the connectors of the three constructions comprise the important aspect of the present invention described above.

The invention will be more fully understood by referring to the following detailed specification and claims taken in connection with the appended drawings.

DESCRIPTION OF THE PREFERRED EMBODIMENTS

Figure 1A:
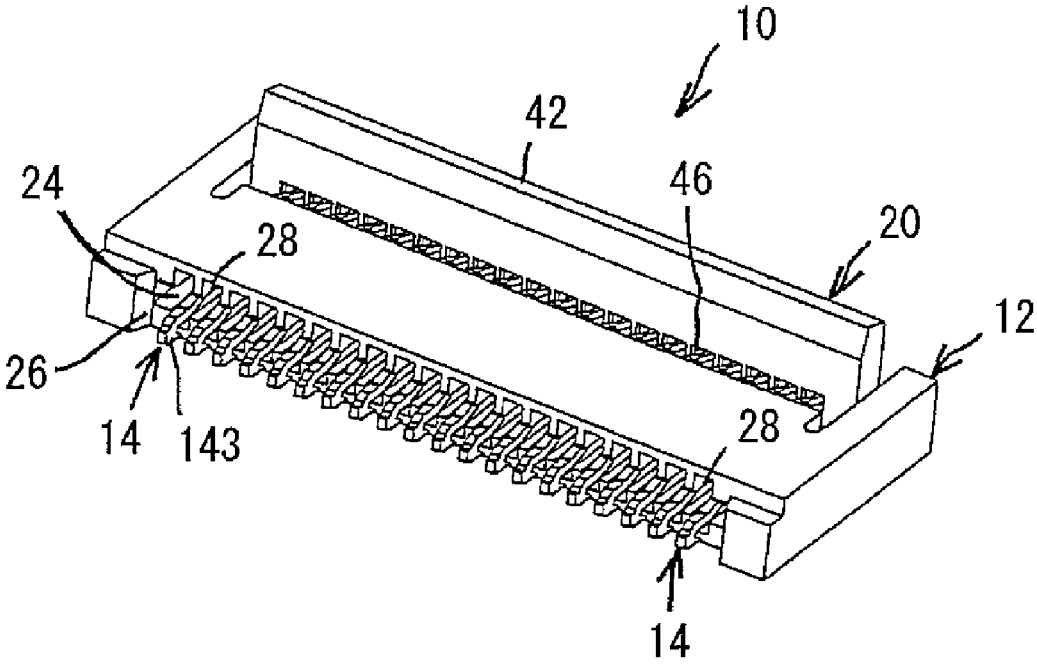
FIG. 1A is a perspective view of the connector according to the invention, viewed from the side of its fitting opening.
Figure 1B:
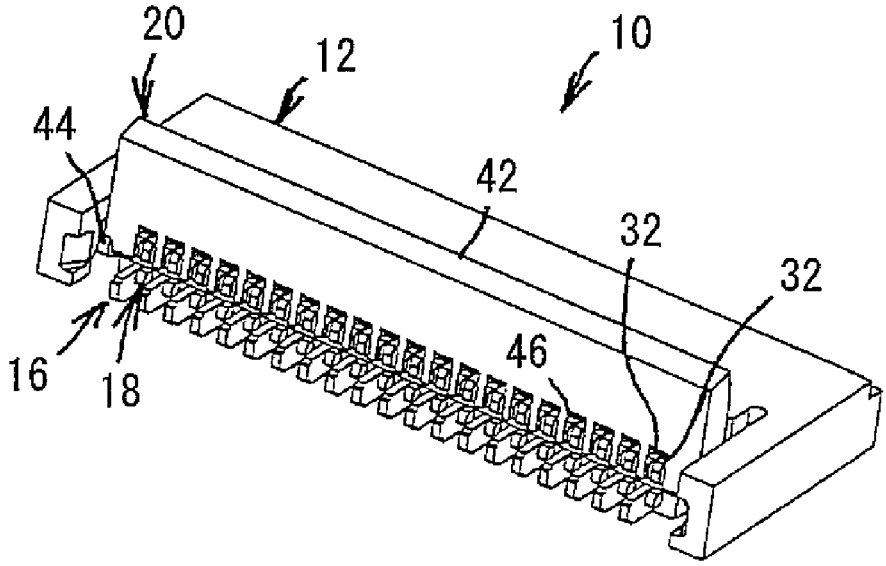
FIG. 1B is a perspective view of the connector according to the invention, viewed from the opposite side of the fitting opening.
Figure 2A:
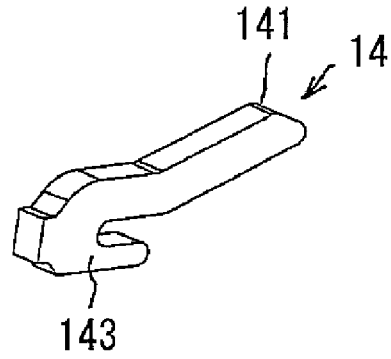
FIG. 2A is a perspective view of a contact A.
Figure 2B:
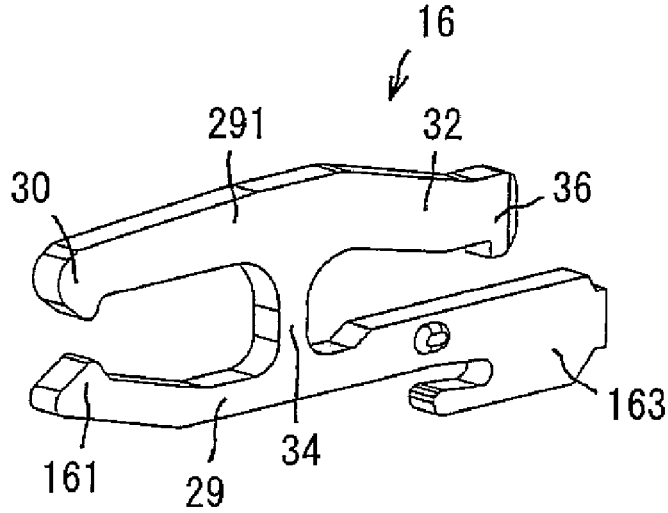
FIG. 2B is a perspective view of a contact B.
Figure 2C:
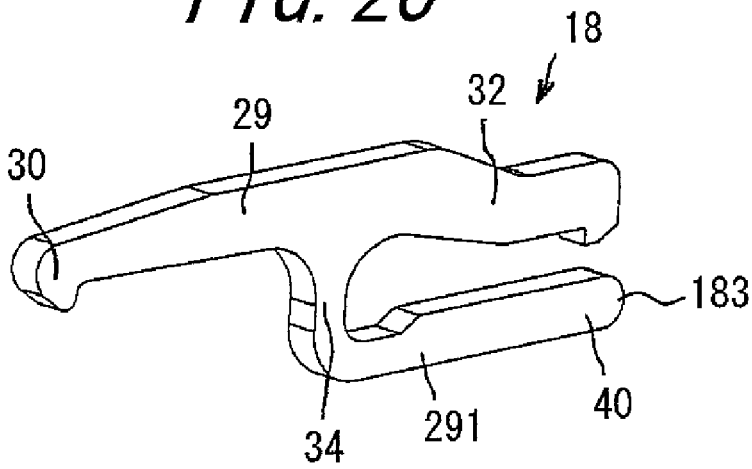
FIG. 2C is a perspective view of a contact C.
Figure 3:
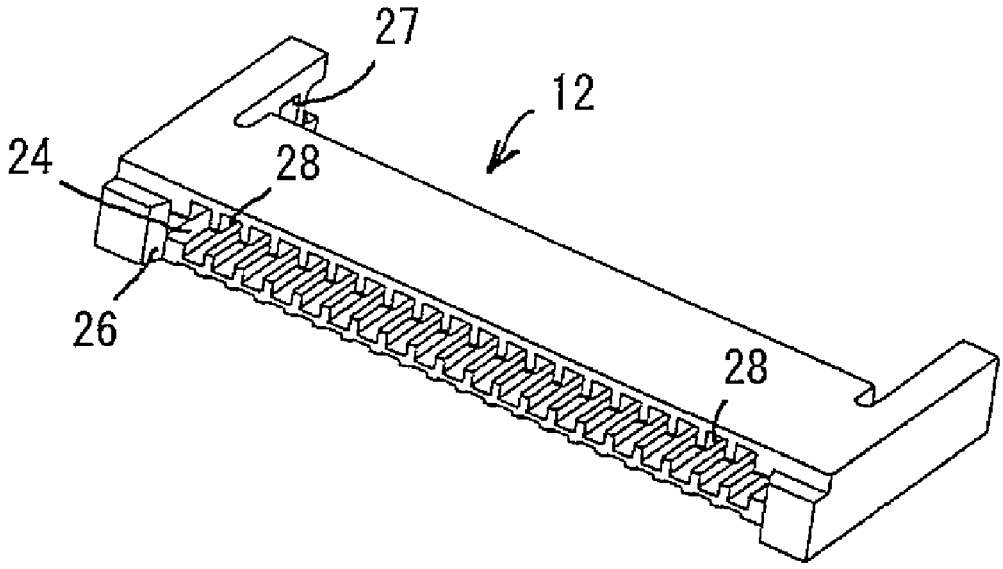
FIG. 3 is a perspective view of a housing.
Figure 4:
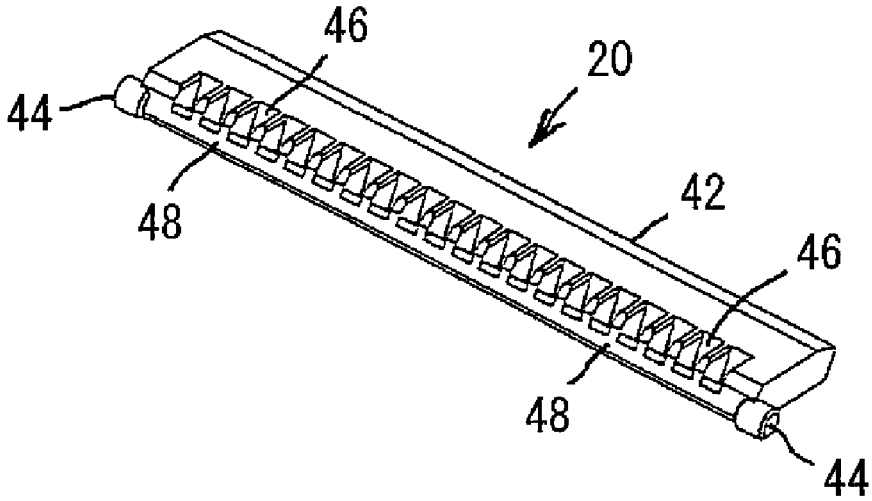
FIG. 4 is a perspective view of a member.
Figure 5A:
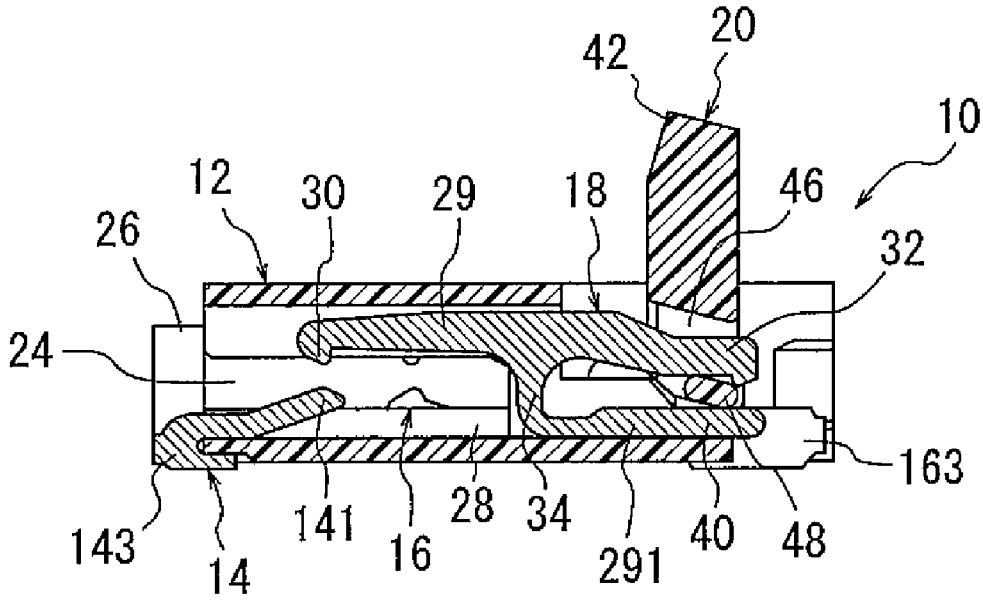
FIG. 5A is a sectional view of the connector not having a flexible printed circuit board to be inserted, taken along the contact A.
Figure 5B:
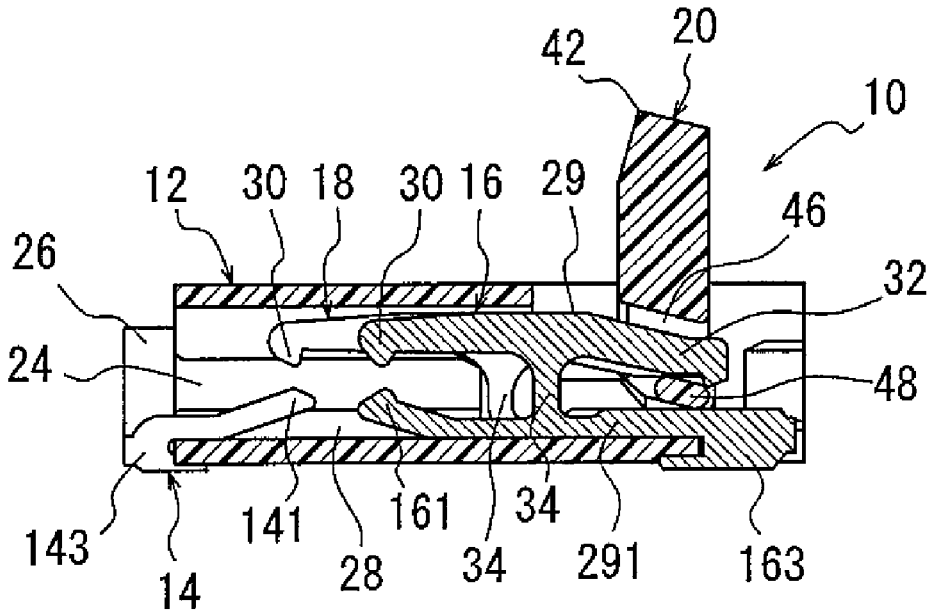
FIG. 5B is a sectional view of the connector not having a flexible printed circuit board to be inserted, taken along the contact B.
Figure 6A:
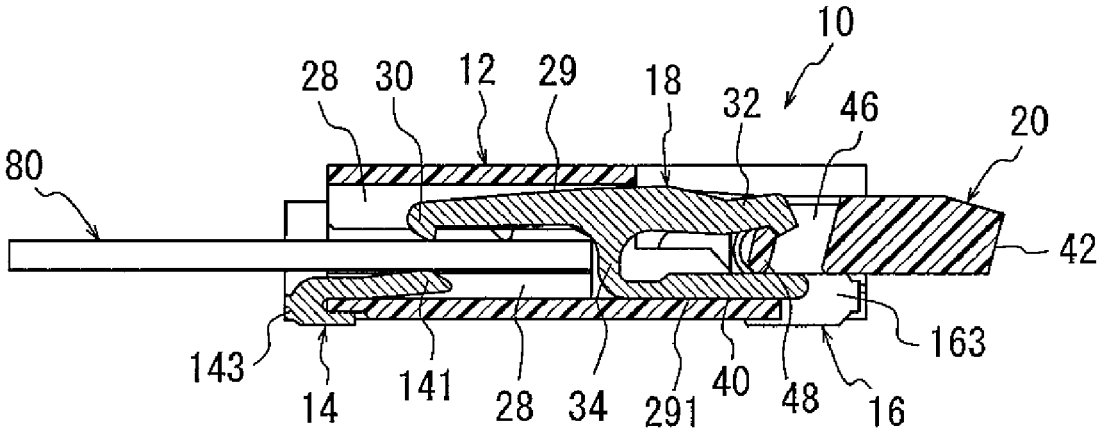
FIG. 6A is a sectional view of the connector with the flexible printed circuit board inserted, taken along the contact A.
Figure 6B:
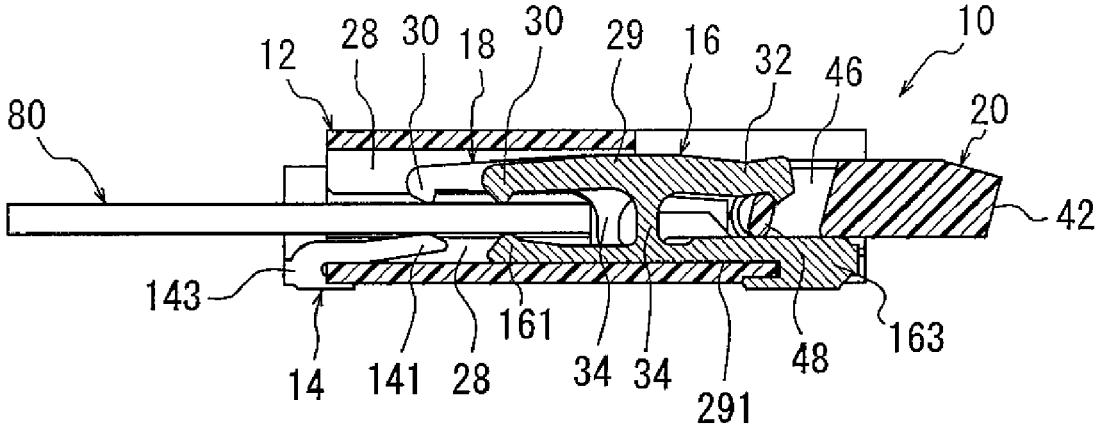
FIG. 6B is a sectional view of the connector with the flexible printed circuit board inserted, taken along the contact B.
Figure 7:
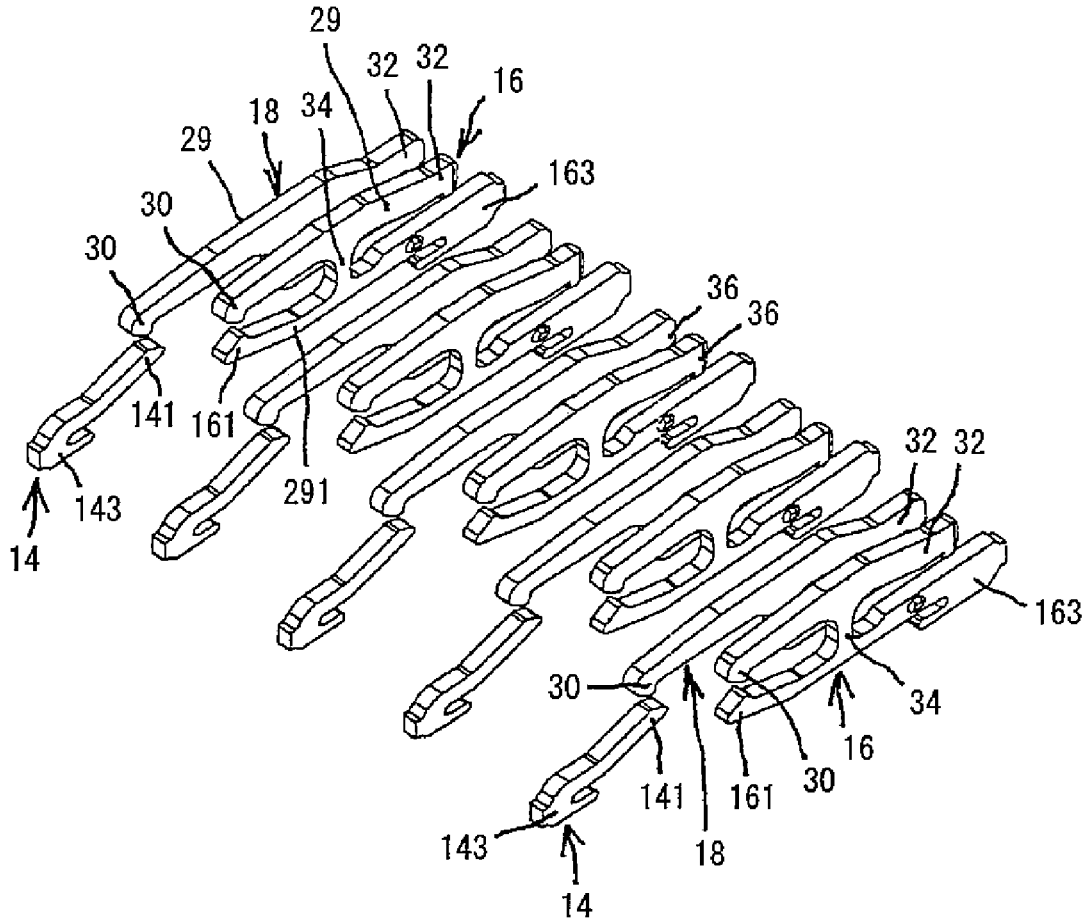
FIG. 7 is a view for explaining the arrangement of the contacts A, contacts B, and contacts C.

One embodiment of the connector according to the invention will be explained with reference to FIG. 1A to FIG. 7. FIG. 1A is a perspective view of the connector according to the invention viewed from the side of its fitting opening, and FIG. 1B is a perspective view of the connector according to the invention viewed from the opposite side of the fitting opening. FIG. 2A is a perspective view of a contact A, FIG. 2B is a perspective view of a contact B, and FIG. 2C is a perspective view of a contact C. FIG. 3 is a perspective view of the housing, while FIG. 4 is a perspective view of the member. FIG. 5A is a sectional view of the connector taken along the contact A not having a flexible printed circuit board inserted, while FIG. 5B is a sectional view of the connector taken along the contact B not having the circuit board. FIG. 6A is a sectional view of the connector taken along the contact A with the flexible printed circuit board inserted, and FIG. 6B is a sectional view of the connector taken along the contact B with the flexible printed circuit board inserted. FIG. 7 is an explanatory view for the arrangement of the contacts A, contacts B and contacts C.

First, a connector 10 of a zero-insertion force (ZIF) type will be explained, which uses a member 20 to bring contacts 14 and 16 into contact with a flexible printed circuit board 80. The connector 10 of the one embodiment mainly comprises a housing 12, the member 20, and the contacts of three kinds (contacts A 14, contacts B 16, and contacts C 18). For arranging the contacts in the connector 10, the contact 14, the contact 16, and contact 18 of the three kinds are inserted into the same or one inserting hole, but in different directions. In more detail, said contact A 14 is inserted into one inserting hole from the side of the fitting opening 24 of the housing, while said contact B 16 and said contact C 18 are inserted into the same inserting hole from the opposite side of the fitting opening 24.

Before explaining the components of the connector, the flexible printed circuit board 80 will be explained. Said flexible printed circuit board 80 mainly comprises contact portions adapted to contact the contact portions 141 and 161 of the contacts 14 and 16, and patterns connecting from the contact portions of the circuit board to circuits. In the illustrated embodiment, the contact portions of said flexible circuit board 80 are arranged only on its rear face.

At first, the housing 12 will be explained, which is one important aspect of the invention. The housing 12 is formed from an electrically insulating plastic material by means of the injection molding of the known technique. The materials for the housing 12 may be suitably selected in consideration of dimensional stability, workability, manufacturing cost, and the like and generally include polybutylene terephthalate (PBT), polyamide (66PA or 46PA), liquid crystal polymer (LCP), polycarbonate (PC) and the like and combination thereof.

Said housing 12 is formed with a required number of inserting holes 28, each of which three contacts of three kinds, that is, the contact A 14, contact B 16, and contact C 18 are inserted. The contacts 14, 16 and 18 of the three kinds are fixed to the housing by press-fitting, hooking (lancing), welding and the like. Said contact A 14 is inserted into one of said inserting holes 28 from the side of the fitting opening 24 of the housing, and said contact B 16 and said contact C 18 are inserted from the opposite side of the fitting opening 24 into the inserting hole into which said contact A 14 has been already inserted.

Said contact A 14 and said contact C 18 inserted in the same inserting hole are aligned with each other, while said contact A 14 and said contact B 16 are arranged so that the contact portion 141 of the contact A 14 and the contact portion 161 of the contact B 16 are staggered relative to each other. Connection portion 163 of said contact B 16 and extension portion 40 of said contact C 18 are arranged in parallel with each other.

Said housing 12 is formed with the fitting opening 24 for inserting said flexible printed circuit board 80 and is provided on the side of the fitting opening 24 with recesses 26 for inducing said flexible printed circuit board 80. The size of the recesses 26 may be suitably designed so as not to permit the connection portions 141 of said contacts A 14 to extend from the interior of the recesses 26 of said housing 12 and in consideration of the strength of said housing 12, soldability of said contact A 14, and easy guidance for said flexible printed circuit board 80. The size of said fitting opening 24 may be suitably designed in a manner such that the flexible printed circuit board 80 can be inserted into the fitting opening 24, and can be urged against and brought into contact with the contact portions 141 and 161 of said contacts A 14 and B 16 when said member 20 is operated (insertion and pivotal movement (rotational movement) of said member 20) upon insertion of said flexible printed circuit board. Said housing 12 is provided at both the longitudinal ends with bearing portions 27 for receiving axles 44 of said member 20 to permit it to pivotally move relative to the housing in the case of pivotal movement (rotational movement) system. The shape and size of the bearing portions 27 need only enable the axles 44 of said member 20 to rotate and may be suitably designed in consideration of such a function, strength and size of the housing 12, and the like. Moreover, the housing is provided at both the longitudinal ends with anchoring portions at locations corresponding to locking portions of said member 20. Such a member 20 for the pivotal movement (rotational movement) system is sometimes called "pivoting member".

The contacts of the three kinds (the contacts A 14, contacts B 16, and contacts C 18) will then be explained, whose feature is an important aspect of the present invention. These contacts 14, 16 and 18 of three kinds are made of a metal and formed by means of the press-working of the known technique. Preferred metals from which to form these contacts include brass, beryllium copper, phosphor bronze and the like which comply with the requirements as to springiness, electric conductivity, and the like.

The contacts of the three kinds (contacts A 14, contacts B 16, and contacts C 18) will be explained, respectively. First, said contacts A 14 will be explained.

Said contacts A 14 are substantially I-shaped as shown in FIG. 2A and each comprise at one end a connection portion 143 to be connected to a substrate and at the other end a contact portion 141 adapted to contact said flexible printed circuit board 80. When the flexible printed circuit board 80 is inserted, it is embraces by said contact portions 141 and urging portions 30 of said contacts C 18 to bring these contacts into contact with and continuity with the circuit board 80. The shape of said contact portions 141 may be any one so long as stable connection with the circuit board can be obtained, and may be suitably designed in consideration of contact stability, thickness of the circuit board, and the like. In the illustrated embodiment, the contact portions 141 are in the form of the rounded protrusion in order to make it easy to contact the circuit board. Moreover, the contact portions 141 are inclined so as to extend into the fitting opening 24 to obtain the stable contact. The connection portions 143 are of a surface mounting type (SMT) in the illustrated embodiment, but may be of a dip type.

Said contacts B 16 will then be explained. Said contacts B 16 each comprise a first piece 29 having at one end a contact portion 161 adapted to contact said flexible circuit board 80 and at the other end a connection portion 163 to be connected to a substrate, a second piece 291 having at one end an urging portion 30 facing to said contact portion 161 for embracing said flexible printed circuit board 80, and an elastic jointing portion 34 for connecting the firs piece 29 and the other end of the second piece 291. With this construction, it becomes possible to take a so-called non-zero-insertion force (N-ZIF) structure not shown (that is, said flexible printed circuit board 80 is inserted into the gap between said contact portions 161 and said urging portions 30, which is narrower than the thickness of the circuit board 80) and a so-called member inserting structure not shown (that is, after said circuit board 80 has been inserted, the member is inserted into the gap between said circuit board 80 and said urging portions 30). In the two structures described above, part of the housing may be used in substitution for said urging portions 30 without providing the urging portions 30. In the so-called non-zero-insertion force (N-ZIF) structure, the gap between said contact portions 161 and said urging portions 30 (or part of the housing 12) should be narrower than the thickness of said circuit board 80 and may be suitably designed in consideration of the contact stability. In the case of the so-called member inserting structure, the gap between said contact portions 161 and said urging portions 30 (or the part of the housing 12) may be suitably designed in consideration of the thickness of said circuit board 80 and the contact stability.

In the illustrated embodiment, the member 20 is pivotally moved (rotated) to bring said flexible printed circuit board 80 into contact with said contacts B 16. Therefore, each of the contacts B 16 is provided with a pressure receiving portion 32 extending from the other end of the second piece 291 so as to face the connection portion 163 in addition to the construction described above. As the result of this, the contacts B 16 are substantially in the form of "H" shape as shown in FIG. 2B. Said urging portion 30 said elastic jointing portion 34, and said connection portion 163 are arranged substantially in the form of a crank, and said contact portion 161 is arranged so as to face said urging portion 34. The shape of said contact portions 161 may be any one insofar as stable contact with said circuit board 80 is obtained, and may be suitably designed in consideration of the contact stability, the thickness of said circuit board 80, and the like. In the illustrated embodiment, the contact portions 161 are in the form of a rounded protrusion in order to make it easy to contact the circuit board. Moreover, the contact portions 161 are inclined so as to extend into the fitting opening 24 to obtain the stable contact. Said connection portions 163 are of a surface mounting type (SMT) in the illustrated embodiment, but may be of a dip type. Further, the shape of said urging portions 30 may be of any one insofar as the stable contact with said circuit board 80 is obtained by embracing it between said contact portions 161 and the urging portions 30, and may be suitably designed in consideration of the contact stability, the thickness of the circuit board 80, and the like. In the illustrated embodiment, the urging portions are in the form of a rounded protrusion in order to make it easy to embrace the circuit board.

Said contacts C 18 will then be explained. Said contacts C 18 each comprise a first peace 29 having at one end an urging portion 30 on the side facing to the contact portion 141 of said contact A 14 for embracing said flexible printed circuit board 80, a second peace 291 parallel to the connection portion 163 of said contact B 16 and in contact with the lower surface of said inserting hole 28 of said housing 12, and an elastic jointing portion 34 connecting the other end of the first piece 29 and the second piece 291. The elastic jointing portion 34 of said contact C 18 serves to maintain the distance between the first piece 29 and the second piece 291. With this construction, it becomes possible to take a so-called non-zero-insertion force (N-ZIF) structure not shown (that is, said flexible printed circuit board 80 is inserted into the gap between said contact portions 141 and said urging portions 30, which is narrower than the thickness of the circuit board 80) and a so-called member inserting structure not shown (that is, after said circuit board 80 has been inserted, said member is inserted between said circuit board 80 and said urging portions 30). In the two structures described above, part of the housing may be used in substitution for said urging portions 30 without providing the urging portions. In the so-called non-zero-insertion force (N-ZIF) structure, the gap between said contact portions 141 of said contacts A 14 and said urging portions 30 (or part of the housing 12) should be narrower than the thickness of said circuit board 80 and may be suitably designed in consideration of the contact stability. In the case of the so-called member inserting structure, the gap between the contact portions 141 of said contacts A 14 and said urging portions 30 (or the part of the housing 12) may be suitably designed in consideration of the thickness of said circuit board 80 and the contact stability.

In the illustrated embodiment, the member 20 is pivotally moved (rotated) to bring said flexible printed circuit board 80 into contact with said contacts C 18. Therefore, each of the contacts C 18 is provided with a pressure receiving portion 32 extending from the other end of the first piece 29 in parallel with said pressure receiving portion 32 of said contacts B 16, and with an extension portion 40 extending from one end of the second piece 291 onto the side facing to the pressure receiving portion 32 in addition to the construction described above. As the result of this, the contacts C 18 are substantially in the form of "h" shape as shown in FIG. 2C. Said urging portion 30 said elastic jointing portion 34, and said extension portion 40 are arranged substantially in the form of a crank, and said urging portion 30 is arranged so as to face the contact portions 141 of said contacts A 14. The shape of said urging portions 30 may be any one so long as stable contact with said circuit board 80 is obtained by embracing said circuit board 80 by the contact portions 141 of said contacts A 14 and the urging portions 30, and may be suitably designed in consideration of the contact stability, the thickness of said circuit board 80, and the like. In the illustrated embodiment, the urging portions 30 are in the form of a rounded protrusion in order to make it easy to embrace the circuit board. Cam portions 48 of said member 20 are pivotally moved (rotated) at the extension portions 40. The shape of said extension portions 40 may be of any one so long as the cam portions 48 of said member 20 can be pivotally moved (rotated) between said pressure receiving portions 32 and said extension portions 40. For example, a connection portion 183 similar to that of said contact B 16 may be provided at the tip end of each of said extension portions 40.

Said elastic jointing portions 34 and said pressure receiving portions 32 of said contacts B 16 and said contacts C 18 perform the following functions when said flexible printed circuit board 80 is inserted. After said circuit board 80 has been inserted into the fitting opening 24 of said housing 12, when the cam portions 48 of said member 20 are pivotally moved (rotated) between the pressure receiving portions 32 and the connection portions 163 of said contacts B 16 and between the pressure receiving portions 32 and the extension portions 40 of said contacts C 18, said pressure receiving portions 32 of both the contacts B 16 and C 18 are raised by said cam portions 48 so that the elastic jointing portions 34 of said contacts B 16 and C 18 are tilted toward the contact portions 141 and 161 of said contacts A 14 and said contacts B 16, with the result that the urging portions 30 of said contacts B 16 and C 18 are urged toward said flexible printed circuit board 80, thereby bringing said flexible printed circuit board 80 into contact with the contact portions 141 and 161 of said contacts A 14 and B 16. The sizes and shapes of said elastic jointing portions 34 and said pressure receiving portions 32 may be suitably designed in order to achieve the functions described above. Moreover, the distal ends of the pressure receiving portions 32 of said contacts B 16 and C 18 are each provided with a projection 36. These projections 36 are adapted to engage anchoring holes 46 of said member 20 upon rotation of the cam portions 48 of said member 20 between the pressure receiving portions 32 and the connection portions 163 and 183 of said contacts B 16 and said contacts C 18. In this manner, it is desirable to prevent the center of the member 20 from being outwardly deformed owing to the strong reaction against the pivotal movement of said member 20. The size of said projections 36 may be any one insofar as the projections 36 serve to achieve their function, and may be suitably designed so as to engage the anchoring holes of the member 20.

The arrangement of the contacts of the three kinds (the contacts A 14, B 16, and C 18) will be explained herein with reference to FIG. 7. As described in the description of the housing 12, the contacts of the three kinds (the contact A 14, contact B 16 and contact C 18) are inserted into the same or common inserting hole 28 of said housing 12. Said contact A 14 is inserted into the inserting hole 28 from the side of the fitting opening 24, while said contact B 16 and said contact C 18 are inserted into the inserting hole 28 from the opposite side of the fitting opening 24. As shown in FIG. 7, said contact A 14 and said contact C 18 are arranged in alignment with each other, while said contact A 14 and said contact B 16 are so arranged that their respective contact portions 141 and 161 are staggered relative to each other. The respective connection portions 163 and 183 of said contact B 16 and said contact C 18 are located in parallel with each other. Said contact B 16 and said contact C 18 may contact each other without any objection. Moreover, the contact portion 141 of said contact A 14 and the urging portion 30 of said contact C 18 are arranged to face each other.

As one object is to minimize the pitch of the contacts, the thicknesses of the three kinds of the contacts (the contacts A 14, B 16 and C 18) are less than 0.12 mm.

Finally, the member 20 will be explained. The member 20 is formed from an electrically insulating plastic material by means of the injection molding of the known technique. The materials for the member 20 may be suitably selected in consideration of dimensional stability, workability, manufacturing cost, and the like and generally include polybutylene terephthalate (PBT), polyamide (66PA or 46PA), liquid crystal polymer (LCP), polycarbonate (PC) and the like and combination thereof.

As described in the explanation of said housing 12, there are two kinds of members, that is, one member which is pivotally moved (rotated) to bring contacts into contact with a flexible printed circuit board 80, and the other member which is inserted to bring contacts into contact with the circuit board 80. In the type of the member (not shown) to be inserted, after the flexible circuit board 80 has been inserted into the fitting opening 24 of said housing 12, the member is inserted between said flexible printed circuit board 80 and the urging portions 30 of said contacts A 14 and B 16 or part of said housing 12, thereby bringing said flexible printed circuit board 80 into contact with the contact portions 141 and 161 of said contacts A 14 and B 16.

In the illustrated embodiment, by the pivotal movement (rotation) of said member 20, said flexible printed circuit board 80 is brought into contact with the contact portions 141 and 161 of said contacts A 14 and B 16. Said member 20 mainly comprises axles 44 adapted to be fitted in the housing 12 for permitting the pivotal movement of the member 20, the cam portions 48 adapted to urge the pressure receiving portions 32 of said contacts B 16 and said contacts C 18, the anchoring holes 46 adapted to engage the projections 36 of said contacts B 16 and said contacts C 18, and an actuating portion 42 for actuating the member 20. Said axles 44 are a fulcrum for pivotally moving said member 20, and said member 20 is pivotally mounted on the housing 12 by fitting the axles 44 in both the longitudinal ends of the housing 12.

The cam portions 48 of said member 20 serve to urge or push the pressure receiving portions 32 of said contacts B 16 and said contacts C 18, and an elongated shape of the cam portions 48 is desirable. An elliptical shape is employed for the cam portions 48 in the illustrated embodiment. By employing the elliptical shape, when the member 20 is pivotally moved, its cam portions 48 are rotated between the pressure receiving portions 32 and the connection portions 163 and 183 of the contacts B 16 and C 18 so that the pressure receiving portions 32 of said contacts B 16 and C 18 are raised with the aid of the difference in length between major and minor axes of the ellipse, thereby urging or pushing the flexible printed circuit board 80 against the contact portions 141 and 161 of said contacts A 14 and B 16. The shape of the cam portions 48 may be any one so long as the cam portions 48 can be rotated between the pressure receiving portions 32 and the connection portions 163 and 183 of said contacts B 16 and C 18, and the pressure receiving portions 32 of said contacts B 16 and C 18 can be raised by the difference in length such as between major axes of an ellipse.

In order to prevent the center of said member 20 from being outwardly deformed owing to the strong reaction against the pivotal movement of the member 20, moreover, the member 20 is provided with the anchoring holes 46 independently from one another adapted to engage the projections 36 of said contacts B 16 and C 18. By providing said anchoring holes 48 independently from one another, the strength of said member 20 is increased, and the deformation of the member 20 is prevented upon its pivotal movement.

Said member 20 described above is pivotally mounted on said housing 12 on the opposite side of the fitting opening 24.

Although the member 20 is shown to be pivotally moved onto the opposite side of the fitting opening 24 (pivotally moved onto the side of the connection portions of said contacts B 16 and C 18), it is to be understood that the member 20 may be pivotally moved onto the side of the fitting opening.

Example of applications of the present invention include connectors for use in electric and electronic appliances such as mobile devices, and particularly connectors which achieve extremely narrow pitches and high-density of contacts for the connecting objects such as flexible printed circuit boards and flexible flat cables.

While the invention has been particularly shown and described with reference to the preferred embodiments thereof it will be understood by those skilled in the art that the foregoing and other changes in form and details can be made therein without departing from the spirit and scope of the invention.

What is claimed is:

1. A connector with which a flexible printed circuit board is detachably fitted, including a required number of contacts each having a contact portion adapted to contact said flexible printed circuit board, and a housing having inserting holes for arranging and fixing said contacts therein and having a fitting opening for inserting said flexible printed circuit board therein, wherein the contacts of three kinds (contact A, contact B, and contact C) are inserted into the same inserting hole of said housing in a manner that the contact (the contact A) of one kind is inserted into the inserting hole from the side of the fitting opening and the remaining contacts (the contact B and the contact C) of the two kinds are inserted in parallel with each other into the inserting hole from the opposite side of the fitting opening, wherein said contact (the contact A) of the one kind and one (the contact C) of the remaining contacts of the two kinds are arranged in alignment with each other, and said contact (the contact A) of the one kind and the other contact (the contact B) of the two kinds are arranged to be staggered relative to each other, and wherein upon insertion of said flexible printed circuit board into said fitting opening, said flexible printed circuit board becomes into contact with said contacts (the contacts A) of the one kind and said other contacts (the contacts B) of the two kinds, wherein said contacts A each comprise at one end a connection portion and at the other end a contact portion adapted to contact said flexible printed circuit board, wherein said contacts B each comprise a first piece having at one end a contact portion adapted to contact said flexible printed circuit board and at the other end a connection portion to be connected to a substrate, a second piece having at one end an urging portion facing to said contact portion of said first piece to sandwich said flexible printed circuit board, and an elastic jointing portion for connecting the first piece and the other end of the second piece, and wherein said contacts C each comprise a first piece having at one end an urging portion facing to the contact portion of said contact A for embracing said flexible printed circuit board, a second piece being substantially parallel to the connection portion of said contact B and in contact with the lower surface of said inserting hole of said housing, and an elastic jointing portion for connecting the other end of the first piece and the second piece, and upon insertion of said flexible printed circuit board into said fitting opening, the flexible printed circuit board comes into contact with said contacts A and said contacts B.

2. The connector as set forth in claim 1, wherein said contacts B are each provided at the second piece with a pressure receiving portion extending from the other end of the second piece and facing to the connection portion of said contact B, and said contacts C are each provided at the first piece with a pressure receiving portion extending from the other end of the first piece substantially in parallel with the pressure receiving portion of said contact B and further provided at the second piece with an extension portion extending from the one end of the second piece and facing to said pressure receiving portion of the first piece, and wherein a member is mounted on said housing on the opposite side of the fitting opening and is provided with anchoring holes into which the pressure receiving portions of said contacts B and said contacts C are inserted and with cam portions for urging the pressure receiving portions of said contacts B and said contacts C, and said member is rotated between the pressure receiving portions and the connection portions of said contacts B and between the pressure receiving portions and the extension portions of said contacts C to cause the urging portions of said contacts B and said contacts C to urge said flexible printed circuit board, thereby bringing the contact portions of said contacts A and said contacts B into contact with said flexible printed circuit board.

3. The connector as set forth in claim 2, wherein the contact portions of said contacts A and said contacts B are inclined.

* * * * *